US005820425A

United States Patent [19]

Ogino et al.

[11] Patent Number: 5,820,425

[45] Date of Patent: Oct. 13, 1998

[54] OUTBOARD DRIVE LOWER UNIT

[75] Inventors: Hiroshi Ogino; Yoshikazu Nakayasu, both of Hamamatsu, Japan

[73] Assignee: Sanshin Kogyo Kabushiki Kaisha, Japan

[21] Appl. No.: 707,654

[22] Filed: Sep. 4, 1996

Related U.S. Application Data

[63] Continuation-in-part of Ser. No. 346,397, Nov. 29, 1994, Pat. No. 5,575,698.

[30] Foreign Application Priority Data

Sep. 4, 1995 [JP] Japan ..... 7-226602

[51] Int. Cl.[6] ..... B63H 20/32

[52] U.S. Cl. ..... 440/78

[58] Field of Search ..... 440/75, 76, 78, 440/79, 80, 900

[56] References Cited

U.S. PATENT DOCUMENTS 4,810,218 3/1989 Iwai ..... 440/66
4,832,635 5/1989 McCormick ..... 440/78
4,898,553 2/1990 Bankstahl ..... 440/76
5,575,698 11/1996 Ogino ..... 440/75

*Primary Examiner*—Jesus D. Sotelo
*Attorney, Agent, or Firm*—Knobbe, Martens, Olson & Bear, LLP

[57] ABSTRACT

A lower unit for an outboard drive has an elongated length in order to present a streamline shape while providing sufficient width to house a transmission for a counter-rotational propeller system with a forwardly-oriented clutch element. One of the clutch elements of the transmission lies in front of the transmission gears to increase the flow area through an exhaust discharge path behind the transmission. In order to accommodate this transmission structure, the lower unit has an increased with at a point forward of the associated drive shaft. The lower unit also has an increased length as measured from the drive shaft forward in order to present a streamline shape within the water. The elongated length of the lower unit also improves the directional and rolling stability of the outboard drive.

20 Claims, 3 Drawing Sheets

OUTBOARD DRIVE LOWER UNIT

This application is a continuation-in-part of U.S. patent application Ser. No. 08/346,397, filed Nov. 29, 1994, which issued as U.S. Pat. No. 5,575,698 on Nov. 19, 1996.

BACKGROUND OF THE INVENTION

1. Field of the Invention

The present invention relates to a marine propulsion system. In particular, the present invention relates to a lower unit of an outboard drive.

2. Description of Related Art

Many outboard drives of marine watercraft employ forward/neutral/reverse transmissions together with a dual propeller propulsion system. Such transmissions are common in both outboard motors and in outboard drive units of inboard/outboard motors.

These transmissions typically include a driving bevel gear and a pair of oppositely rotating driven bevel gears. Each driven gear includes a hub that is journaled within a lower unit of the outboard drive. A front dog clutch of a dual clutch assembly is interposed between the pair of oppositely rotating gears. In this position, the front dog clutch moves between positions in which the clutch engages the gears. The front dog clutch selectively couples an inner propeller shaft to one of the driven gears to rotate a rear propeller in either a forward or a reverse direction.

The transmission also includes a second dog clutch that is positioned to the rear side of the rear driven gear hub. The rear clutch selectively engages corresponding teeth formed on the rear side of the hub of the rear gear to drive an outer propeller shaft. The outer propulsion shaft in turn drives a front propeller.

Such prior transmission designs tend to occupy a significant amount of space in the lower unit on the rear side of the drive shaft. The lower unit also houses an exhaust passageway for the discharge of engine exhaust.

The large size of prior transmissions used with counterrotational propulsion systems commonly leaves less space for the exhaust passage though the lower unit. Inadequate exhaust flow area can result in higher back pressure, and consequently engine exhaust tends not to discharge smoothly. Engine performance consequently suffers. This problem becomes more acute with larger engines. In such case, it becomes necessary to increase the flow area of the exhaust passage through the lower unit in order to discharge exhaust gas smoothly.

Lower units thus have increased in size to accommodate the larger exhaust passages with current transmission designs. An increased size in the lower unit, however, undesirably increases the resistance to fluid flow around the lower unit, i.e., undesirably increases the drag on the lower unit.

Another disadvantage associated with prior transmissions used with counterrotational propulsion systems is that such systems rotate the rear propeller when driving the watercraft in the reverse direction. The front propeller, however, tends to block the thrust stream produced by the rear propeller and thereby inhibits the performance of the outboard drive when operated in reverse.

Summary of the Invention

In order to address these problems, a transmission has been proposed which includes one of the clutching element of the transmission positioned in front of the driven gears.

Although this transmission provides space for an adequately sized exhaust passage through the lower unit, as well as improves reverse thrust when driving in reverse, it has resulted in the lower unit having a large width close to the front end of the lower unit. As a result, the lower unit as a lessen streamline shape as the enlarged width gives the front end of the lower unit a generally blunt configuration. A need therefore exists for a lower unit which provides adequate space to accommodate the desired transmission while presenting a generally streamline shape when passing through the water.

One aspect of the present invention thus involves an outboard drive comprising a uniquely configured lower casing. The casing houses a transmission which selectively couples a drive shaft of the outboard drive to first and second propulsion shafts. Each propulsion shaft extends along a common propulsion axis from the transmission to drive a propulsion device. The transmission comprises first and second counter-rotating gears which are driven by the drive shaft. A first clutch element is connected to the first propulsion shaft and is interposed between the first and second gears. A second clutch element is connected to the second propulsion shaft and is coupled to the first clutch element. The second clutch element is positioned on a side of the first and second gears opposite of the propulsion devices and is movable between an engaged position and a neutral position. The lower casing is configured such that a length of the lower casing from the second clutch element when in the neutral position to a front end of the lower casing, as measured in a direction parallel to the propulsion axis, is greater than a width of the lower casing at the position of the second clutch element, as measured in a direction normal to the propulsion axis.

In accordance with another aspect of the present invention, an outboard drive comprises a lower unit. The lower unit includes a transmission which is housed within a casing of the lower unit. The transmission is adapted to selectively couple a drive shaft to at least one propulsion shaft. A shift rod is coupled to the transmission so as to actuate the transmission. The shift rod is positioned on a front side of the transmission at a position where a first distance between an axis of the shift rod and a front end of the casing is greater than a second distance between the axis of the shift rod and an axis of the drive shaft.

An additional aspect of the present invention involves an outboard drive for a watercraft comprising a lower unit. The lower unit houses a transmission which selectively couples a drive shaft of the outboard drive to a pair of propulsion shafts. The propulsion shafts drive a pair of counter-rotating propellers that lie in series along a common rotational axis. The lower unit has a length which is longer than the sum of the lengths of the propellers, with all lengths being measured along the rotation axis. This configuration of the lower unit improves the directional and rolling stability of the outboard drive.

BRIEF DESCRIPTION OF THE DRAWINGS

These and other features of the invention will now be described with reference to the drawings of a preferred embodiment, which is intended to illustrate and not limit the invention, and in which.

DETAILED DESCRIPTION OF THE PREFERRED EMBODIMENT OF THE INVENTION

Figure 1:
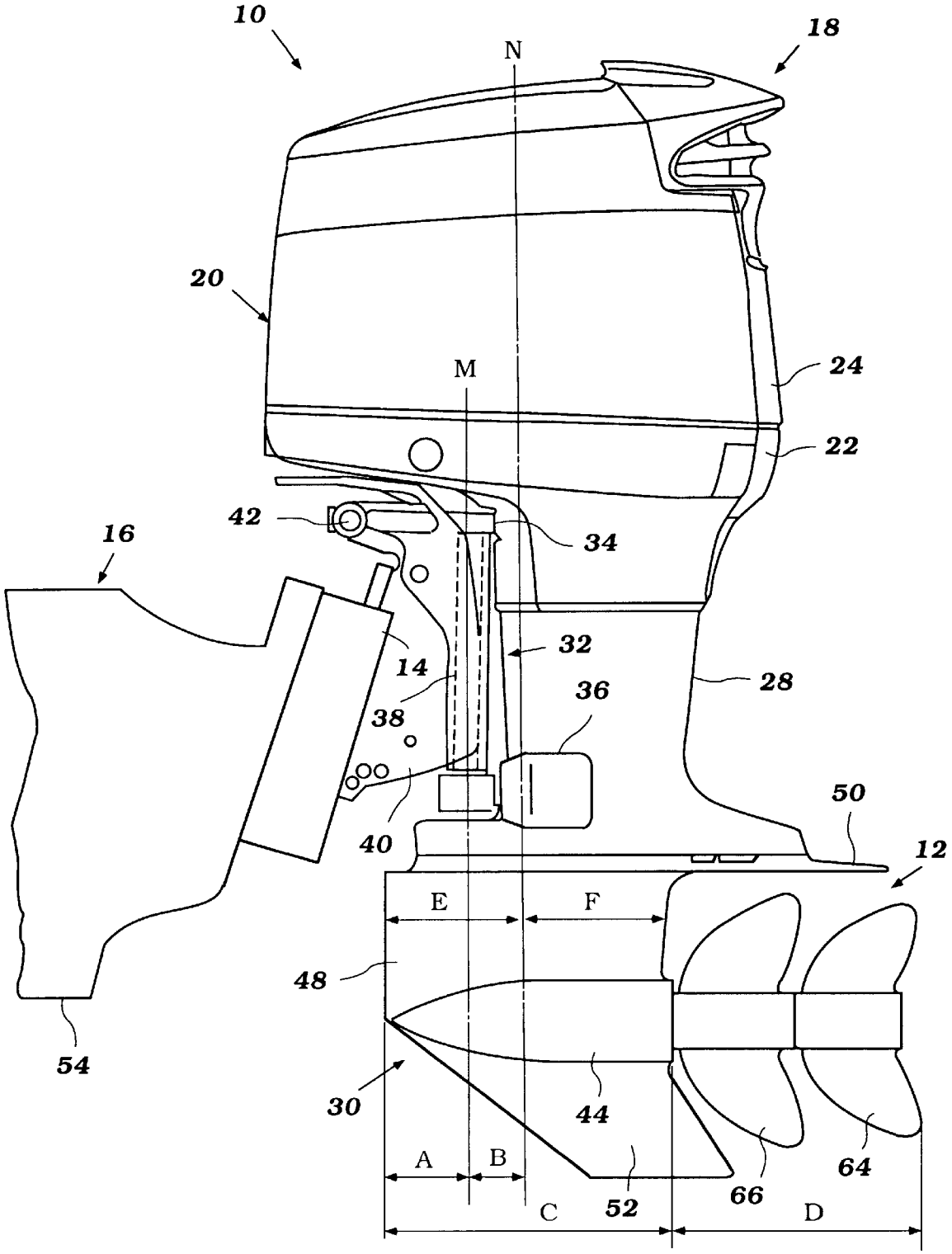
FIG. 1 is a side elevational view of a marine outboard drive which embodies a lower unit configured in accordance with a preferred embodiment of the present invention.

FIG. 1 illustrates a marine outboard drive 10 which incorporates a uniquely configured lower unit that supports a propulsion device 12. The lower unit is configured in accordance with the preferred embodiment of the present invention. In the illustrated embodiment, the outboard drive 10 depicted is an outboard motor for mounting on the transom 14 of a watercraft 16. It is contemplated however that those skilled in the art will readily appreciate that the present invention can be applied to stern drive units of inboard/outboard motors and to other types of watercraft drive units as well.

In the illustrated embodiment, the outboard drive 10 has a power head 18 which includes an engine (not shown). A conventional protective cowling 20 surrounds the engine. The cowling 20 desirably includes a lower tray 22 and a top cowling 24. These components, 22 and 24, of the protective cowling 20, together define an engine compartment which houses the engine.

The engine is mounted conventionally with its output shaft (i.e., crankshaft) rotating about a generally vertically extending access. The crankshaft (not shown) drives a drive shaft 26 (FIG. 2) as is known in the art. The drive shaft 26 depends from the power head 18 of the outboard drive 10 and rotates about a generally vertically extending axis indicated by the letter N in FIGS. 1 and 2 and is henceforth referred to as the drive shaft axis. The drive shaft axis N also can be the axis about which the crankshaft for the engine rotates, though this is not a necessary condition for the practice of the invention.

A drive shaft housing 28 extends downward from the lower tray 22 and terminates in a lower unit 30. The drive shaft 26 extends through and is journaled within the drive shaft housing 28.

A steering shaft assembly 32 is affixed to the drive shaft housing 28 by upper and lower brackets 34 and 36, respectively. The brackets 34 and 36 support a steering shaft 38 for steering movement. Steering movement occurs about a generally vertically extending steering axis that is indicated by the letter M in FIGS. 1 and 2 and extends through the steering shaft 38 parallel to the drive shaft axis N. As seen in FIG. 1, the steering axis M is disposed forward of the drive shaft axis N by a distance B. A steering arm (not shown) can be connected to an upper end of the steering shaft and can extend in a forward direction for manual steering of the outboard drive 10 as is well-known in the art.

The steering shaft assembly 32 also is pivotally connected to a clamping bracket 40 by a pin 42. The clamping bracket 40 in turn is configured to attach to the transom 14 of the watercraft 16. This conventional coupling permits the outboard drive 10 to be pivoted relative to the pin 42 to permit adjustment of the trim position of the outboard drive 10 and for tilt-up of the outboard drive 10.

Although not illustrated, it is understood that a conventional hydraulic tilt and trim cylinder assembly as well as a conventional hydraulic steering cylinder assembly can be used with the present outboard drive 10. The construction of the steering and trim mechanism is considered to be conventional and for that reason further description is not believed necessary for appreciation and understanding of the present invention.

The lower unit 30 includes a nacelle 44 which houses a transmission 46. A strut 48 suspends the nacelle 44 beneath an upper anti-cavitation plate 50 while a skeg 52 extends downwardly from the lower surface of the nacelle 44. The anti-cavitation plate 50 extends over the nacelle 44 and beyond the rear end of the nacelle 44 to cover at least a portion of the propulsion device 12.

The outboard drive 10 desirably is positioned on the watercraft transom 14 such that the anti-cavitation plate 50 resides at some height above the bottom of the watercraft hull 54 near the transom 14. In this high mount position, the outboard drive 10 is positioned such that the propulsion device 12 pierces through the water surface of the body of water in which the watercraft 16 is operated when the watercraft 16 is up on plane. In the illustrated embodiment the mount position of the outboard drive 10 and the transom 14 locates the rotational axis of the propulsion device 12 beneath the water surface when the watercraft 16 is planing.

The nacelle 44 extends horizontally beneath the anti-cavitation plate 50 and spans a length that is indicated by the letter C. As best seen in FIG. 1, the strut 48 and skeg 52 also span about the length C which is somewhat greater than the length D of the propulsion device 12. In outboard motors of conventional design the length D is generally greater than the length C. As will be discussed in detail later, however, this invention, by increasing the length C of the strut 48 and skeg 52, improves certain facets of the operation of the outboard drive 10.

The nacelle 44 is further divided into horizontal lengths E and F which respectively extend forwardly and rearwardly of the drive shaft axis N and are equal in length. Additionally, the forward portion E of the nacelle is divided into lengths A and B which extend forwardly and rearwardly of the steering shaft axis M respectively. Again, in outboard drives of conventional design the length B is generally greater then the length A. As will be discussed in detail later, increasing the length A simplifies and improves the design of the transmission 46 of the outboard drive 10.

Figure 2:
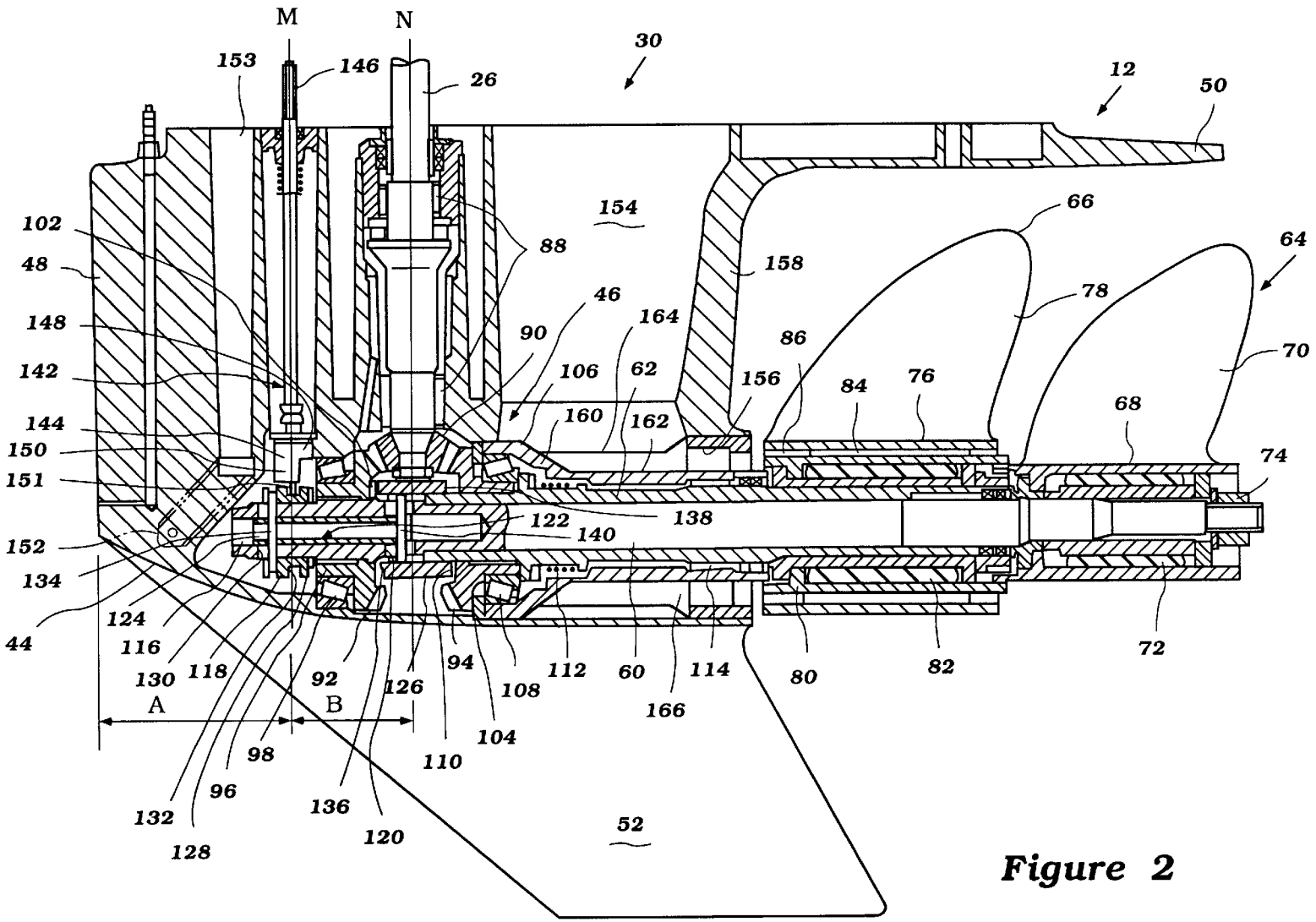
FIG. 2 is a sectional side elevational view of the lower unit and a propulsion device of the outboard drive of FIG. 1.

With reference now to FIG. 2, the drive shaft 26 extends from the drive shaft housing 28 into the lower unit 30 where the transmission 46 selectively couples the drive shaft 26 to an inner propulsion shaft 60 and to an outer propulsion shaft 62. The transmission 46 advantageously is a forward/neutral/reverse type transmission. In this manner, the drive shaft 26 drives the inner and outer propulsion shafts 60 and 62 which rotate in a first direction and then a second counter-direction respectively in any of these operational states as described below in detail.

The propulsion shafts 60 and 62 drive the propulsion device 12. The propulsion device 12 is a counter-rotating propeller device that includes a rear propeller 64 designed to spin in one direction and to assert a forward thrust, and a front propeller 66 designed to spin in the opposite direction and to assert a forward thrust. The front and rear propellers 66 and 64 are located within the region D as shown in FIG. 1. The counter-rotational propulsion device 12 will be explained in detail below.

FIG. 2 illustrates the components of the front and rear propellers 66 and 64. The rear propeller 64 includes a hub 68 to which propeller blades 70 of any suitable pitch are integrally attached. The rear propeller 64 is driven by the inner propulsion shaft 60. For this purpose, an elastic bushing 72 is interposed between the inner surface of the rear propeller hub 68 and the outer surface of the inner propulsion shaft 60 and compressed therebetween. The bushing 72 is secured by a heat process that is known in the art. This frictional engagement between the hub 68, bushing 72 and inner propulsion shaft 60 is sufficient for transmitting drive from the inner propulsion shaft 60 to the rear propeller 64. The hub 68 is fixed onto the rear end of the inner propulsion shaft 60 between a retaining nut 74 secured onto the rear of the inner shaft 60 and a step in diameter of the inner shaft 60.

The front propeller 66 includes an outer propeller hub 76. Propeller blades 78 with a pitch that may be different from the pitch of the blades 70 of the rear propeller 64 are integrally formed on the exterior of the hub 76. The outer hub 76 of the front propeller 66 has a larger diameter than the diameter of the rear propeller hub 68. Likewise, the propeller diameter of the front propeller 66 is larger than the propeller diameter of the rear propeller 64.

The front propeller 66 also includes an inner hub 80. The inner hub 80 surrounds a second annular elastic bushing 82 which is held under pressure between the inner hub 80 and the outer surface of the outer propulsion shaft 62 in frictional engagement. This frictional engagement is sufficient for transmitting a rotational force from the outer propulsion shaft 62 to the inner propeller hub 80.

A plurality of radial ribs 84 extend between the inner hub 80 and the outer hub 76 to support the outer hub 76 about the inner hub 80 and to form passages 86 through the front propeller 66. Engine exhaust from an engine exhaust system is discharged through these passages 86 in a manner which will be described in detail later.

Figure 3:
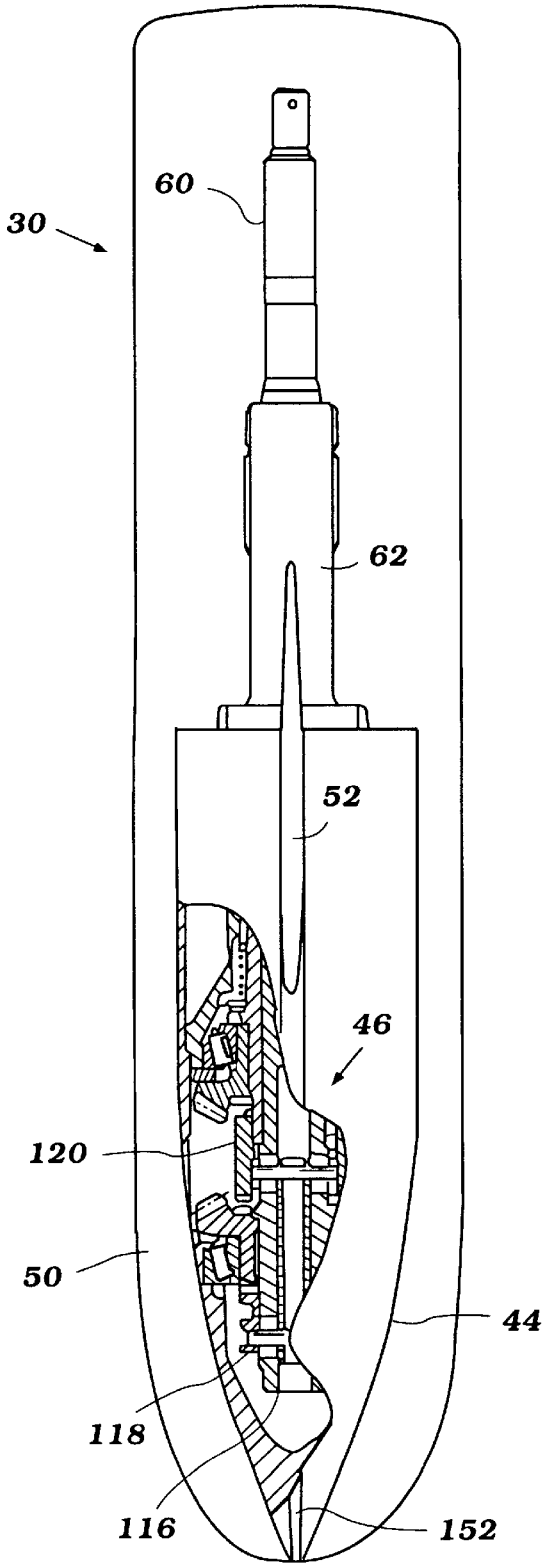
FIG. 3 is a partial sectional, bottom plan view of the lower unit and propulsion shafts of the propulsion device.

In the illustrated embodiment, the outer propulsion shaft 62 is a tubular shaft. The inner propulsion shaft 60 extends through the outer propulsion shaft 62. The shafts 60 and 62 desirably are coaxial and rotate about a common longitudinal axis. The individual components of the present transmission 46 will now be described in detail with reference to FIGS. 2 and 3. The lower end of the drive shaft 26 is suitably journaled within the lower unit 30 by a pair of bearing assemblies 88. At its lower end, the drive shaft 26 carries a drive gear or pinion 90 which forms a portion of the transmission 46. The pinion 90 preferably is a bevel type gear.

The transmission 46 also includes a pair of counter-rotating driven gears 92 and 94 that are in mesh engagement with the pinion 90. The pair of driven gears 92 and 94 preferably are positioned on diametrically opposite sides of the pinion 90 and are suitably journaled within the lower unit 30 as described below. Each driven gear 92 and 94 is positioned at about a 90° shaft angle with the drive shaft 26. That is, the propulsion shafts 60 and 62 and the drive shaft 26 desirably intersect at about a 90° shaft angle; however, it is contemplated that the drive shaft 26 and the propulsion shafts 60 and 62 can intersect at almost any angle.

In the illustrated embodiment, the pair of driven gears 92 and 94 are a front bevel gear 92 and an opposing rear bevel gear 94. The front bevel gear 92 is located within the region B and includes a hub 96 which is journaled within the lower unit 30 by a front thrust bearing 98. The thrust bearing 98 rotatably supports the front gear 92 in mesh engagement with the pinion 90.

The hub 96 has a center bore through which the inner propulsion shaft 60 passes. The inner propulsion shaft 60 is suitably journaled within the central bore of the front gear hub 96.

The front gear 92 also includes a series of teeth 100 on an annular front facing engagement surface and includes a series of teeth 102 on an annular rear facing engagement surface. Teeth 100 and 102 on each surface positively engage a portion of a clutch of the transmission 46 as described below.

The rear gear 94 is located within the region F and also includes a hub 104 which is suitably journaled within a bearing carrier 106 by a rear thrust bearing 108. The rear thrust bearing 108 rotatably supports the rear gear 94 in mesh engagement with the pinion 90.

The hub 104 of the rear gear 94 has a central bore through which the inner propulsion shaft 60 and the outer propulsion shaft 62 pass. The rear gear 94 also includes an annular front engagement surface which carries a series of teeth 110 for positive engagement with the clutch of the transmission 46 as described below.

The bearing carrier 106 rotatably supports the hollow outer propulsion shaft 62 within the lower unit 30. A front needle bearing 112 journals the front end of the outer propulsion shaft 62 within the bearing carrier 106 while a rear needle bearing 114 supports the outer propulsion shaft 62 within the bearing carrier 106 at an opposite end of the bearing carrier 106 from the front needle bearing 112.

The inner propulsion shaft 60 extends through the front gear hub 96 and is suitably journaled therein. At the rear gear 94, the inner propulsion shaft 60 extends through the outer propulsion shaft 62 and is suitably journaled therein.

The front end of the inner propulsion shaft 60 includes a longitudinal bore 116. The bore 116 transverses the region B and extends forwardly and rearwardly into the regions A and F respectively. The bore 116 extends from the front end of the inner propulsion shaft 60 to a point within the hub 104 of the rear gear 94. The longitudinal bore 116 communicates with lubricant passages (not shown) within the inner shaft 60 positioned at the rear end of the longitudinal bore 116.

The transmission 46 includes a front clutch 118 and a rear clutch 120 coupled to a plunger 122. As discussed in detail below, the front clutch 118 is located at the interface between the regions A and B and selectively couples the inner propulsion shaft 60 to the front gear 92. The rear clutch 120 is located at the interface between the regions E and F and selectively couples the outer propulsion shaft 62 either to the front gear 92 or the rear gear 94. FIG. 2 illustrates the front clutch 118 and the rear clutch 120 set in a forward position (i.e., in a position which the clutches 118 and 120 engage the front gear 92). In the illustrated embodiment the clutches 118 and 120 are positive clutches such as, for example, dog clutch sleeves. However, it is contemplated that the present transmission 46 could be designed with friction-type clutches.

The plunger 122 is cylindrically shaped and slides within the longitudinal bore 116 of the inner shaft 60 generally within the region B to activate the clutches 118 and 120 and is desirably hollow (i.e., is a cylindrical tube).

The plunger 122 also includes a front hole 124 that is positioned generally transverse to the longitudinal axis of the plunger 122 and a rear slot 126 that is likewise positioned generally transverse to the longitudinal axis of the plunger 122. Though not illustrated, the transmission 46 also includes a neutral detente mechanism to hold the plunger 122 and the coupled clutches 118 and 120 in the neutral position. The neutral detente mechanism operates between the plunger 122 and the inner propulsion shaft 60 and is located toward the front end of the inner propulsion shaft 60.

The front dog clutch 118 has a generally cylindrical shape that includes an axial bore which extends through an annular front end and a flat annular rear end of the clutch 118 and is sized to receive the inner propulsion shaft 60. Internal splines are formed on the wall of the axial bore and mate with external splines formed on the front end of the inner propulsion shaft 60. The resulting spline connection establishes a driving connection between the front clutch 118 and the inner propulsion shaft 60 while permitting the clutch 118 to slide along the front end of the inner propulsion shaft 60.

The annular rear end surface of the clutch 118 lies generally transverse to a longitudinal axis of the inner propulsion shaft 60. The rear surface of the front dog clutch 118 also is substantially coextensive in the area with the annular front surface of the front gear 92. Teeth 128 extend from the clutch rear surface in the longitudinal direction and desirably correspond with the teeth 100 on the front surface of the front driven gear 92 both in size (i.e., axial length), in number, and in configuration.

A pair of annular grooves circumscribe the exterior of the front clutch 118. A front groove 130 is sized to receive a retaining spring as described below. The rear groove 132 is sized to cooperate with an actuator mechanism which will be described below.

The front clutch 118 also includes a transverse hole that extends through the clutch 118 at the location of the front annual groove 130. The hole is sized to receive a pin 134 which extends through the front of the inner propulsion shaft 60 and the plunger 122 to interconnect the plunger 122 and the front clutch 118 on the inner propulsion shaft 60. The pin 134 may be held in place by a press fit connection between the pin 134 and the front hole or by conventional coil spring (not shown) which is contained within the front annular groove 130 about the exterior of the front clutch 118.

The rear clutch 120 is disposed between the two counter-rotating driven gears 92 and 94. The rear clutch 120 has a tubular shape that includes an axial bore which extends between an annular front end and an annular rear and is sized to receive a portion of the outer propulsion shaft 62 which is positioned about the inner propulsion shaft 60.

The annular end surfaces of the rear clutch 120 are substantially coextensive in size with the annular engagement surfaces of the front and rear gears 92 and 94, respectively. Teeth 136 extend from the front end of the rear clutch 120 and desirably correspond to the respective teeth 102 of the front gear 92 in size (e.g., axial length), in number, and in configuration. Teeth 138 likewise extend from the rear end surface of the rear clutch 120 and desirably correspond to the respective teeth 110 of the rear gear 94 in size (e.g., axial length), in number, and in configuration.

The front engagement end of the rear clutch 120 advantageously carries a greater number of teeth 136 than the rear engagement end of the rear clutch 120 and a greater number of teeth than the front clutch 118. In the illustrated embodiment, the front clutch 118 and the rear engagement end of the rear clutch 120 desirably include the same number of clutching teeth 128 and 138, respectively. The front engagement end of the rear clutch 120 desirably includes twice as many teeth 136 as the number of teeth on the rear engagement end of the rear clutch 120. In this manner, the torque load per tooth 136 when the rear clutch 120 engages the front gear 92 is about the same as the torque load per tooth 128 and 138 when the front clutch 118 engages the front gear 92 and the rear clutch 120 engages the rear gear 94 even though the entire torque transmitted by the drive shaft 26 is being transmitted to the outer propulsion shaft 62 through the rear clutch 120. In addition, the fewer number of teeth involved when the clutches 118 and 120 simultaneously engage the gears 92 and 94 eases shifting because registration between the corresponding teeth is achieved quicker.

A spline connection couples the rear clutch 120 to the outer propulsion shaft 62. The clutch 120 thus drives the outer propulsion shaft 62 through the spline connection, yet the clutch 120 can slide along the front end of the shaft 62 between the front and rear gears 92 and 94.

The rear clutch 120 also includes a counter bore that is sized to receive a coupling pin 140 which extends through the rear of the inner propulsion shaft 60 and through the rear slot 126 of the plunger 122. The pin 140 has a diameter smaller than the length of the slot 126. In the illustrated embodiment the diameter of the pin 140 is about half of the length of the slot 126. The pin 140 couples the plunger 122 to the rear clutch 120 in order for the plunger 122 to actuate the rear clutch 120 as described below.

An actuator mechanism 142 moves the plunger 122 of clutch assembly from a position establishing a forward drive condition in which the front and rear clutches 118 and 120 engage the front and rear gears 92 and 94, respectively, through a position of non-engagement (i.e., the neutral position) and to a position establishing a reverse drive condition in which the rear clutch 120 engages the front gear 92. The actuator mechanism 142 positively reciprocates the plunger 122 between these positions.

The actuator mechanism 142 is intersected by the steering axis M and includes a cam member 144 that connects the front clutch 118 to a rotatable shift rod 146. In the illustrated embodiment the shift rod 146 is journaled for rotation about the steering axis M in the lower unit 30 and extends upwardly to a transmission actuator mechanism (not shown) positioned within the outboard motor cowling 20. The actuator mechanism 142 converts rotational motion of the shift rod 146 into a linear movement of the front clutch 118 to move the front clutch 118 as well as the plunger 122 and the rear clutch 120 along the longitudinal axis of the propulsion shafts 60 and 62.

The cam member 144 is affixed to the lower end of the shift rod 146. The cam member 144 includes an eccentrically positioned drive pin (not shown) which extends downwardly from the cam member 144. The cam member 144 also includes a cylindrical upper portion 148 which is positioned to rotate about the axis of the shift rod 146 and is journaled within the lower unit 30.

A follower 150 of the actuator mechanism 142 generally has a rectangular blocklike shape with a retention arm 151 depending from one end. The retention arm 151 advantageously depends from the leading edge of the follower 150 relative to designed rotation of the clutch 118. The retention arm 151 holds the follower 150 on the clutch 118 with the follower 150 captured between the clutch 118 in the rear groove 132 and the lower end of the cam member 144.

The follower 150 also includes a slot which is formed on the upper side of the follower 150. The slot has a width generally equal to the diameter of the drive pin of the cam member 144. The drive pin extends into the follower 150 and is captured between the walls of the follower 150.

The follower 150 has a width generally equal to the width of the rear annular groove 132 of the front clutch 118. The height of the follower 150 also generally matches the distance between the lower end of the cam member 144 and base of the rear groove 132. In this manner, the rear groove 132 receives and captures the follower 150 of the actuator mechanism 142.

The drive pin of the cam member 144 moves both axially and transversely with the rotation of the cam member 144 because of the eccentric position of the drive pin relative to the rotational axis of the cam member 144. The slot of the follower 150, thus, desirably has a sufficient length to accommodate the transverse travel of the drive pin as the cam member 144 rotates between positions corresponding to the forward and reverse drive conditions. The axially travel of the drive pin causes the follower 150 and the coupled clutch 118 to move axially sliding over the inner propulsion shaft 60 as discussed in detail below.

The front clutch 118, thus, is coupled to the cam member 144 with the follower 150 cradled between the walls of the rear annular groove 132 on the front clutch 118. The actuator mechanism 142 configured accordingly positively moves the front clutch 118 along the axis of the inner propulsion shaft 60 with rotational movement of the cam member 144 operated by the shift rod 146. The coupling between the actuator mechanism 142 and the front clutch 118, however, allows the front clutch 118 to rotate with the inner propulsion shaft 60 relative to the follower 150 and the cam member 144.

As noted above, the pin 134 connects the front clutch 118 to the plunger 122. This coupling causes the plunger 122 to rotate with the front clutch 118 and the inner propulsion shaft 60. The coupling also conveys the axial movement of the clutch 118 driven by the actuator mechanism 142 to the plunger 122. The plunger 122, consequently, moves the rear clutch 120.

The following elaborates on the previous description of the operation of the present transmission 46. To establish a forward drive condition, the shift rod 146 rotates the cam member 144 in a manner which moves the drive pin of the cam member 144 axially in the reverse direction. The follower 150, thus, follows the drive pin to slide the front clutch 118 over the inner propulsion shaft 60. The actuator mechanism 142, thereby, forces the front clutch 118 into engagement with the front gear 92 with the corresponding clutch teeth 100 and 128 mating. So engaged, the front gear 92 drives the inner propulsion shaft 60 through the internal spline connection between the clutch 118 and the inner propulsion shaft 60. The inner propulsion shaft 60, thus, drives the rear propeller 64 in the first direction which asserts a forward thrust.

The forward motion of the clutch 118 also causes the plunger 122 to slide within the longitudinal bore 116 of the inner propulsion shaft 60 in the reverse direction due to the direct coupling of the drive pin 134. The plunger 122 moves the rear coupling 140 in the rearward direction to force the rear clutch 120 into engagement with the rear gear 94 with the corresponding teeth 110 and 138 mating.

Simultaneous engagement of the front clutch 118 and the rear clutch 120 seldom occurs. Simultaneous engagement of the clutches 118 and 120 require synchronized registration between the teeth of the front clutch 118 and the front gear 92 and the teeth of the rear clutch 120 and the rear gear 94. The teeth of the gears 92 and 94 and the clutches 118 and 120 are not static, however, and synchronization of the teeth is not a constant condition. Under most conditions, the teeth of the clutches 118 and 120 and the gears 92 and 94 are out of phase.

Once the teeth 138 of the rear clutch 120 register with the teeth 110 of the rear gear 94, the rear clutch 120 engages the rear gear 94. So engaged, the rear gear 94 drives the outer propulsion shaft 62 through the spline connection between the rear clutch 120 and the outer propulsion shaft 62. The out propulsion shaft 62, thus, drives the front propellers 66 to spin in the opposite direction to that of the rear propeller 64 and to assert a forward thrust.

To establish a reverse drive condition, the shift rod 146 rotates in an opposite direction so as to move the cam member 144 and the eccentrically positioned drive pin in a direction which moves the drive pin axially in the forward direction. The forward movement of the drive pin is transferred to the front clutch 118 through the follower 150. This motion is also transferred to the plunger 122 through the clutch 120 and the corresponding coupling pin 134. The forward motion of the plunger 122 positively forces the rear clutch 120 into engagement with the front gear 92 with the corresponding clutch teeth 102 and 136 mating.

Once the corresponding teeth 136 and 102 of the rear clutch 120 and front gear 92 register, the front gear 92 and rear clutch 120 engage. So engaged, the front gear 92 drives the outer propulsion shaft 62 through the spline connection between the rear clutch 120 and the outer propulsion shaft 62. The outer propulsion shaft 62, thus, drives the front propeller 66 in a direction which asserts a reverse thrust to propel the watercraft 16 in reverse.

As previously stated, the region A of the lower unit 30 is longer than the region B for this invention. This means that the lower unit 30 extends further forward than do lower units of a conventional design where the length A is less than the length B. This lower unit configuration has a number of advantages over the conventional design. The increased length of the region A simplifies the packaging of the front clutch 118 within the nacelle 44 and allows the clutch 118 to be positioned in front of the front gear 92 in a manner that maintains a smooth streamline shape for the nacelle 44 which thus minimizes the hydraulic drag of the nacelle 44.

The increased length of the region A also allows for the positioning of a water inlet 152 in the front of the nacelle 44 forward of the transmission 46. Water from the body of water in which the watercraft 16 is operating enters into the lower unit 30 through the inlet 152 and is directed to the engine through a conduit 153 for cooling of the engine in a manner that is well-known in the art. This location for the inlet 152 is superior to the higher location necessary with lower units of conventional design since the likelihood of the inlet 152 being exposed above the level of the body of water in which the watercraft 16 is operating is greatly reduced at this lower location. This, in turn, reduces the likelihood of the engine overheating.

The increased length of the region A also results in an increase in the length C of the strut 48 and the skeg 52 such that it exceeds the length D of the propulsion unit 12. This increase in length of the strut 48 and skeg 52 allows the strut and skeg 48 and 52 to exert greater lateral loads on the outboard drive 10. This reduces the magnitude of the rider steering inputs to the outboard drive 10 necessary for steering of the associated watercraft 16 and increases the directional stability of the outboard drive 10. It also increases the rolling stability of the outboard drive 10 about the propulsion shaft rotational axis by more effectively opposing the rolling motion of the outboard drive 10 when configured with propellers of unequal pitch or when the outboard drive 10 is operating in a reverse condition where only the front propeller 66 is rotating, which tends to roll the outboard drive 10 laterally.

The discharge of exhaust gases from the exhaust system through the front propeller 66 will now be discussed. In the illustrated embodiment, the bearing carrier 106 lies within the lower unit 30, and more specifically within an exhaust discharge conduit 154 of the lower unit 30. The exhaust discharge conduit 154 forms a part of the exhaust system and extends from an upper end of the lower unit 30 to an exhaust outlet 156 formed on a rear wall 158 of the lower unit 30. The exhaust outlet 156 desirably has a circular shape and thread, and also generally is concentrically positioned with the propulsion shafts 60 and 62 about the common drive axis of the shafts 60 and 62.

The exhaust discharge conduit 154 communicates with an expansion chamber (not shown) formed in the drive shaft housing 28. The exhaust system communicates with the engine of the outboard drive 10 and conveys exhaust gases to the expansion chamber for silencing, as is well known in the art. From the expansion chamber, the exhaust gases are discharged through the exhaust discharge conduit 154 and the outlet 156, as described below.

As seen in FIG. 2, the bearing carrier 106 has a generally tubular shape with an enlarged front end 160. The front end 160 is of a sufficient size to receive the bearing arrangement which supports the rear gear 94, the rear dog clutch 120, and the front end of the outer propulsion shaft 62. A generally tubular section 162 extends to the rear of the enlarged front end 160.

A plurality of flanges 164 extend outwardly in radial directions from the enlarged front end 160 and the rear tubular section 162 of the bearing carrier 106. The diameter of the flanges 164 generally equals an inner diameter of the exhaust outlet 156. The flanges 164 locate the tubular section 162 of the bearing carrier 106 in a position generally aligning a longitudinal axis of the bearing carrier 106 with the common axis of the propulsion shafts 60 and 62 when the flanges 164 are positioned within the exhaust outlet 156.

The flanges 164 define a plurality of apertures 166 between the flanges 164, the tubular section 162 of the bearing carrier 106, and the inner wall of the exhaust opening 156. Exhaust gases pass through these apertures 166 when discharged through the opening 156, as described below. The apertures 166 are arranged in an annular shape about the tubular section 162 of the bearing carrier 106.

In operation, the exhaust system conveys exhaust gases from the engine to the exhaust discharge conduit 154 in the lower unit 30. The exhaust gases flow through the exhaust outlet 156 into the passage 86 within the front propeller 66. A discharge end of the exhaust system lies at the rear end of the front propeller 66, between the propeller blades of the first and second propellers 66 and 64.

At low propeller speeds, the exhaust gases discharged between the propellers 66 and 64 aerate the water around the propeller blades 70 of the rear propeller 64. The action of the blades 70 of the rear propeller 64 drives the exhaust gases outwardly away from the hub 68 of the rear propeller 64. The exhaust gases flow over the blade back of the propeller blades 70 and become entrained in the water stream through the propeller 64.

Aeration or cavitation produced by the entrained exhaust gases within the water decrease the viscosity of the water around the blades 70 of the rear propeller 64 to reduce resistance on the blades 70. This permits the propeller 64 to accelerate more quickly. Less propeller resistance, in turn, reduces the load applied by the rear propeller 64 on the engine and more power is available to drive the front propeller 66. The outboard motor 10, consequently, accelerates quicker.

Water speed over the rear propeller 64 increases with rising engine and propeller speeds. Under these conditions, the exhaust gases tend to flow over the hubs 76 and 68 of the front and rear propellers 66 and 64, and have less effect on cavitation. The speed of the exhaust gases, as well as the speed of the water flow through the propellers 66 and 64, carries the gases through the front and rear propellers 66 and 64 in the vicinity of the bases of the propeller blades 78 and 70. As a result, discharge of exhaust gases forward of the propellers 66 and 64 causes no significant loss of propulsion efficiency when traveling at high speeds. The exhaust gases, thus, generally create a cavitation effect, primarily during acceleration.

The discharge of exhaust gases between the propellers 66 and 64 also shortens the length of the exhaust system which reduces back pressure within the exhaust system. Engine performance thus improves as less pressure resists the discharge of exhaust gases from the engine.

It should be readily apparent that the above outboard drive arrangement provides for a lower unit configuration that not only simplifies the design of the transmission but also improves the stability and control of the outboard drive. Of course, the foregoing description is that of a preferred embodiment of the invention and any changes and modifications may be made without exceeding the spirit and scope of the invention as defined by the appended claims.

What is claimed is:

1. An outboard drive comprising a lower unit including a transmission housed within a casing of the lower unit, the transmission being configured to selectively couple a drive shaft to at least one propulsion shaft, and a shift rod coupled to the transmission so as to actuate the transmission, the shift rod being positioned on a front side of the transmission at a position where a first distance between an axis of the shift rod and a front end of the casing is greater than a second distance between the axis of the shift rod and an axis of the drive shaft.

2. An outboard drive as in claim 1, wherein the transmission selectively couples the drive shaft to a pair of coaxial propulsion shafts which extend to the rear of the transmission, and each propulsion shaft drives a propeller of a dual, counter-rotating propeller system about a propulsion axis.

3. An outboard drive as in claim 2, wherein the lower unit includes a nacelle suspended by a strut, and the nacelle houses the transmission with a portion of the coaxial propulsion shafts extending through the nacelle.

4. An outboard drive as in claim 3, wherein the nacelle has a length longer than a length across the propellers as measured in the direction parallel to the propulsion axis.

5. An outboard drive as in claim 3, wherein the lower unit includes a water pick-up port which is located on the nacelle in front of the shift rod.

6. An outboard drive as in claim 3, wherein the nacelle has a streamline shape.

7. An outboard drive as in claim 6, wherein the transmission comprises first and second counter-rotating gears driven by the drive shaft, a first clutch element connected to the first propulsion shaft on the same side of the first and second gears as the shift rod, and a second clutch element connected to the second propulsion shaft and coupled to the first clutch element, the second clutch element interposed between the first and second gears.

8. An outboard drive comprising a lower casing, the casing housing a transmission which selectively couples a drive shaft of the outboard drive to first and second propulsion shafts, each propulsion shaft extending along a common propulsion axis from the transmission to drive a propulsion device, said transmission comprising first and second counter-rotating gears driven by the drive shaft, a first clutch element connected to the first propulsion shaft and interposed between the first and second gears, and a second clutch element connected to the second propulsion shaft and coupled to the first clutch element, the second clutch element being positioned on a side of the first and second gears opposite of the propulsion devices, said second clutch element being movable between an engaged position and a neutral position, the lower casing being configured such that a length of the lower casing from the second clutch element when in the neutral position to a front end of the lower casing, as measured in a direction parallel to the propulsion axis, is greater than a width of the lower casing as measured in a direction normal to the propulsion axis and taken through the second clutch element when in the normal position.

9. The outboard drive as in claim 8, wherein the casing includes a nacelle which houses the transmission.

10. The outboard drive as in claim 9, wherein a length of the nacelle is such that a distance from a front end of the nacelle to a rotational axis of the drive shaft is generally equal to a distance from a rear end of the nacelle to the rotational axis of the drive shaft.

11. The outboard drive as in claim 9, wherein the propulsion shafts drive a pair of counter-rotating propellers which are arranged in series, and the length of the nacelle is longer than a sum of the length of the propellers, with both lengths being measured in a direction parallel to the propulsion axis.

12. The outboard drive as in claim 9, wherein the nacelle includes a water pick-up port which is located in front of the second clutch element.

13. The outboard drive as in claim 8, wherein as measured in a direction parallel to the propulsion axis, the length of the lower casing measured from the position of the second clutch element when in the neutral position to a front end of the lower casing is greater than a distance between the position of the second clutch element when in the neutral position and a rotational axis of the drive shaft.

14. An outboard drive for a watercraft comprising a lower unit which houses a transmission, the transmission selectively coupling a drive shaft of the outboard drive to a pair of propulsion shafts which drive a pair of counter-rotating propellers that are arranged in series along a common rotational axis, the lower unit having a length which is longer than the sum of the lengths of the propellers, with such lengths being measured along the rotation axis.

15. An outboard drive as in claim 14, wherein a distance from a front end of the lower unit to a rotational axis of the drive shaft is generally equal to a distance from a rear end of the lower unit to the rotational axis of the drive shaft, with both distances being measured along the rotational axis of the propulsion shafts.

16. An outboard drive comprising a lower unit including a nacelle and a transmission housed within the nacelle, the transmission being configured to selectively couple a drive shaft to at least one propulsion shaft, the propulsion shaft being coupled to at least one propulsion device, and a steering bracket coupled to the outboard drive and defining a steering axis about which the outboard drive rotates, the nacelle including a front end positioned such that a distance between the front end of the nacelle and the steering axis is greater than the distance between the steering axis and a rotation axis of the drive shaft.

17. An outboard drive as in claim 16, wherein the transmission selectively couples the drive shaft to a pair of coaxial propulsion shafts which extend to the rear of the transmission through the nacelle, and each propulsion shaft drives a propeller of a dual, counter-rotating propeller system about a propulsion axis.

18. An outboard drive as in 17, wherein the nacelle has a length longer that the a combined length of the propellers as measured along the propulsion axis.

19. An outboard drive as in claim 16, wherein the lower unit includes a water pick-up port located on the nacelle forward of the steering axis.

20. An outboard drive as in claim 16, wherein the drive shaft is arranged to rotate about a generally vertical axis and is generally equally distanced from a front end and from a rear end of the nacelle as measured in a direction generally parallel to the propulsion shaft.

* * * * *

UNITED STATES PATENT AND TRADEMARK OFFICE

CERTIFICATE OF CORRECTION

PATENT NO. : 5,820,425

DATED : October 13, 1998

INVENTOR(S) : Hiroshi Ogino et al.

It is certified that error appears in the above-indentified patent and that said Letters Patent is hereby corrected as shown below:

In column 14, claim 18, line 28, please change "that the a" to --than a--.

Signed and Sealed this

Twenty-third Day of November, 1999

*Attest:*

Q. TODD DICKINSON

*Attesting Officer*

*Acting Commissioner of Patents and Trademarks*